US007086922B2

(12) United States Patent
Delgado

(10) Patent No.: US 7,086,922 B2
(45) Date of Patent: Aug. 8, 2006

(54) TRACK FOR MODEL CARS

(76) Inventor: Carlos Delgado, Apartado 207, Aguas Buenas, PR (US) 00703

( * ) Notice: Subject to any disclaimer, the term of this patent is extended or adjusted under 35 U.S.C. 154(b) by 0 days.

(21) Appl. No.: 10/601,839

(22) Filed: Jun. 23, 2003

(65) Prior Publication Data

US 2004/0198168 A1 Oct. 7, 2004

Related U.S. Application Data

(60) Provisional application No. 60/390,681, filed on Jun. 21, 2002.

(51) Int. Cl.
*A63H 29/00* (2006.01)

(52) U.S. Cl. ..... 446/429; 104/23.1

(58) Field of Classification Search ..... 463/64; 446/444, 429, 430; 273/129 AP; 104/138.1, 104/23.1, 23.2; 472/85
See application file for complete search history.

(56) References Cited

U.S. PATENT DOCUMENTS

| | | | | | |
|---|---|---|---|---|---|
| 1,899,706 | A * | 2/1933 | McClean | 463/64 |
| 2,571,081 | A * | 10/1951 | Wilson | 463/64 |
| 3,367,658 | A * | 2/1968 | Bayha | 463/64 |
| 3,469,340 | A * | 9/1969 | Breneman et al. | 446/197 |
| 3,577,677 | A * | 5/1971 | Bennett et al. | 463/64 |
| 3,697,071 | A * | 10/1972 | Anderson | 446/180 |
| 3,789,540 | A * | 2/1974 | Convertine et al. | 446/180 |
| 3,936,053 | A * | 2/1976 | Goldfarb et al. | 446/180 |
| 3,987,581 | A * | 10/1976 | Brown | 463/64 |
| 4,108,437 | A * | 8/1978 | DeAnda et al. | 463/64 |
| 4,174,587 | A * | 11/1979 | Morin et al. | 446/429 |
| 4,209,935 | A * | 7/1980 | Parker | 446/178 |
| 4,247,107 | A * | 1/1981 | Smith et al. | 463/59 |
| 4,438,587 | A * | 3/1984 | Marino | 446/429 |
| 4,521,204 | A * | 6/1985 | Wiggs et al. | 446/198 |
| 4,817,948 | A * | 4/1989 | Simonelli | 446/456 |
| 4,925,188 | A * | 5/1990 | McKay et al. | 446/444 |
| 5,169,156 | A * | 12/1992 | Smollar | 273/371 |
| 5,658,198 | A * | 8/1997 | Nagasaka et al. | 463/64 |
| 6,089,951 | A * | 7/2000 | Ostendorff | 446/444 |
| 6,398,613 | B1 * | 6/2002 | Rehkemper et al. | 446/197 |
| 6,499,409 | B1 * | 12/2002 | Niederer et al. | 104/138.1 |
| 6,910,972 | B1 * | 6/2005 | Norbury | 472/85 |
| 2003/0040254 | A1 * | 2/2003 | Greenberg | 446/427 |

FOREIGN PATENT DOCUMENTS

| | | | |
|---|---|---|---|
| DE | 198 19346 | A1 * | 11/1999 |
| GB | 2276826 | A * | 10/1994 |
| JP | 10094675 | A * | 4/1998 |

* cited by examiner

*Primary Examiner*—Kien Nguyen
(74) *Attorney, Agent, or Firm*—Nils H. Ljungman & Associates

(57) ABSTRACT

A race track for model cars with series of pressurized air conduits. The track is designed to race at least two cars in a manner similar to a "Drag Race." Each car has its own lane. The system of pressurized air propels the cars with bursts of air from jets. The air jets are activated by each operator using a control which is fashioned after an automobile gearshift.

20 Claims, 7 Drawing Sheets

TRACK FOR MODEL CARS

This application claims the benefit of provisional application 60/390,681 filed Jun. 21, 2002.

FIELD OF THE INVENTION

This invention relates to a race track for toy model cars. More specifically, this invention relates to a drag-race style race track in which toy cars are propelled by pressurized air.

BACKGROUND OF THE INVENTION

The automobile racing game has become a favorite in both arcades and home game systems. Since its inception, it has taken on many forms. In some instances, a car race is simulated on a display screen. In others, the race cars are mechanically driven by motors. Still others are electronically operated. Continued consumer demand for the automobile racing game requires the frequent development of fresh, new approaches.

OBJECT OF THE INVENTION

It is an object of the present invention to create a fun, innovative new form of the classic automobile racing game. The embodiments of the present invention offer a setting in which toy cars are pitted against each other in drag race fashion and are operated using controls which simulate those found in a real race car.

SUMMARY OF THE INVENTION

An embodiment of the invention could be a two-lane race track for model cars. The lanes herein may be referred to as the "Left Lane" and the "Right Lane." Each lane could be equipped with a corresponding driver's seat, a gearshift joystick, a clutch, and a series of pressurized air conduits.

The track of one embodiment of the invention could be made of plastic strips which are lined with piping on either side to prevent the car from exiting the track prematurely. The track of one embodiment could be designed to accommodate a "Drag-Race" type format in that the portion of the track in which the race takes place would be straight. Beyond that point, the track could curve around, reversing the course of each car so that the car will return to its operator. The two U-shaped lanes could be arranged side by side so that the straight portions of both lanes are preferably parallel to each other. The racing portion of each lane is preferably positioned on the inside of the platform, while the return portion of each lane follows along the outsides.

The cars of one embodiment of the invention are preferably propelled by pressurized air. This air could travel through conduits. In one embodiment, the air could travel through copper tubes. Each lane could be equipped with its own system of air conduits. The air could be administered to the cars in bursts by a series of air jets. In one embodiment of the invention, the air jets could be positioned at four preferably equidistant points above the track. They are preferably held in place by Y-shaped supports.

The bursts of pressurized air are preferably activated by the operator using the gearshift joystick. Fashioned after a real automobile gearshift, the gearshift joystick could give access to four "gears." Each gear could be a trigger for the bursts of air. In one embodiment of the invention, the gear shift preferably has four such gears. At the precise moment each car passes under the pressurized air jets, the car's respective operator depresses the clutch with his foot and shifts to the gear corresponding to that air jet. If timed properly, the air hopefully accelerates the car in the direction of the finish line. The object of the game, then, is to time the release of the air so that the maximum force possible is exerted on the car.

In one embodiment of the invention, a pole with signal lights is preferably fixed on the end opposite the players. These lights are modeled after the starting lights of a real drag race. They indicate when the race is to begin. A timer display could be fixed to the center of one embodiment of the invention. This timer display could indicate the time taken by each car to finish the race. By this information, the winner of the race is determined.

In one embodiment of the invention, at the start of the race, two players could be seated in the bucket seats, which are preferably positioned on opposite sides of the game platform. Each player places his car at the starting point in his respective lane, below the first air jet. When the starting light indicates to go, the drivers depress their clutches and shift to "first gear," activating the first bursts of air. When the cars pass under the second air jets, their operators shift to "Second gear" and release the second burst of compressed air, and so forth, until all jets have been activated, and subsequently, the cars finish the race. The center timer then displays the amount of time taken by each car to complete the race. The cars coast around the remainder of the track, completing a U-Turn and returning to their respective drivers.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The attached drawings illustrate at least one embodiment of the invention described above.

DESCRIPTION OF THE PREFERRED EMBODIMENT OF THE INVENTION

Figure 1:
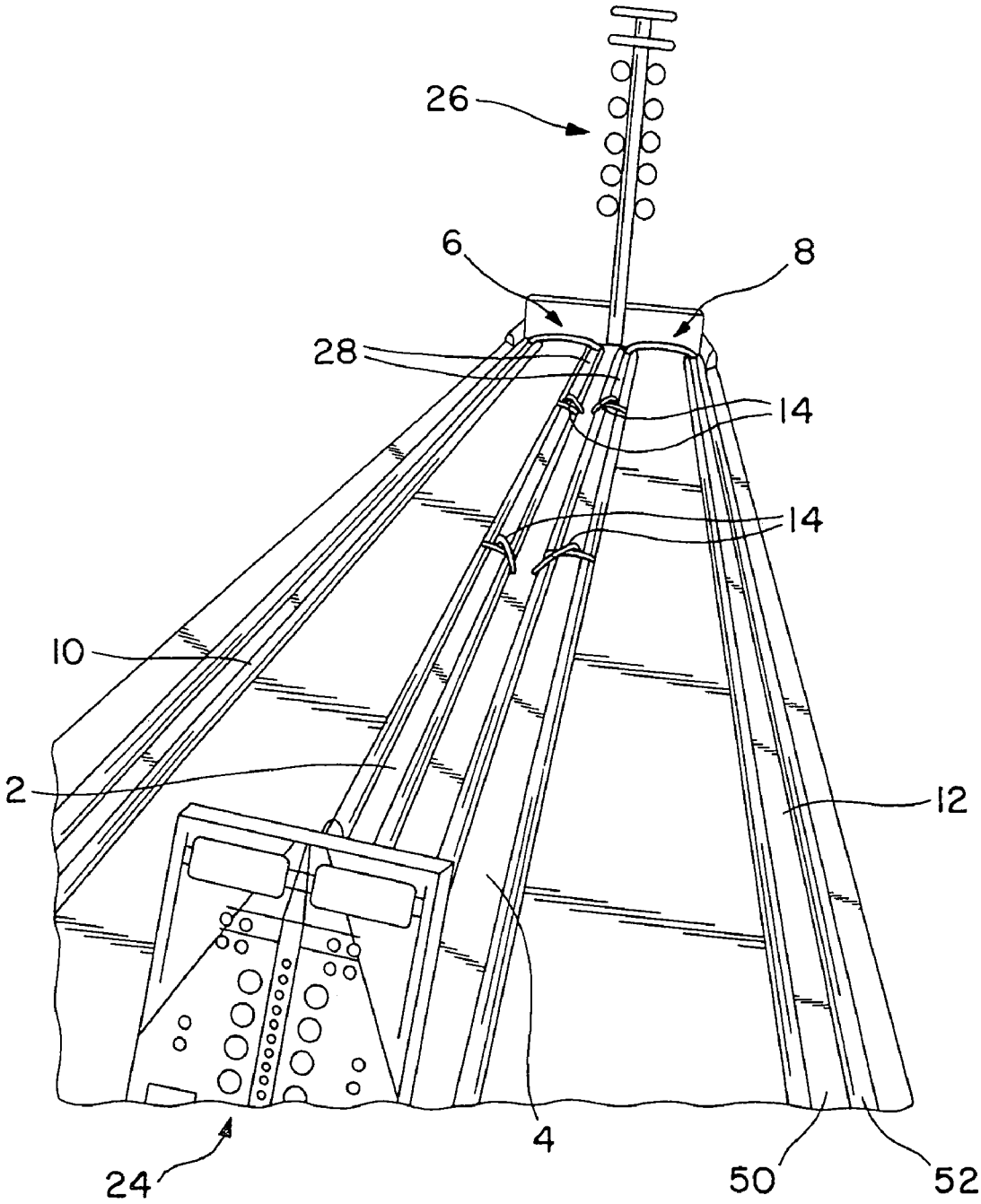
FIG. 1 shows a view of the track.

FIG. 1 shows a view of the track as seen from the perspective of a driver. At the far end of the track opposite the players, the light pole 26 and the U-turn curves 6, 8 are shown. During the game, the cars race by traveling along the inner two sections 2, 4 of the track. After passing the finish line 28, the cars coast back along the U-turns 6, 8, and return to the drivers by way of the outer sections 10, 12 of the track. In the foreground, one can see the game timer 24. The track of one embodiment is constructed out of smooth plastic strips 50 lined with plastic piping 52 to guide the cars.

Figure 2:
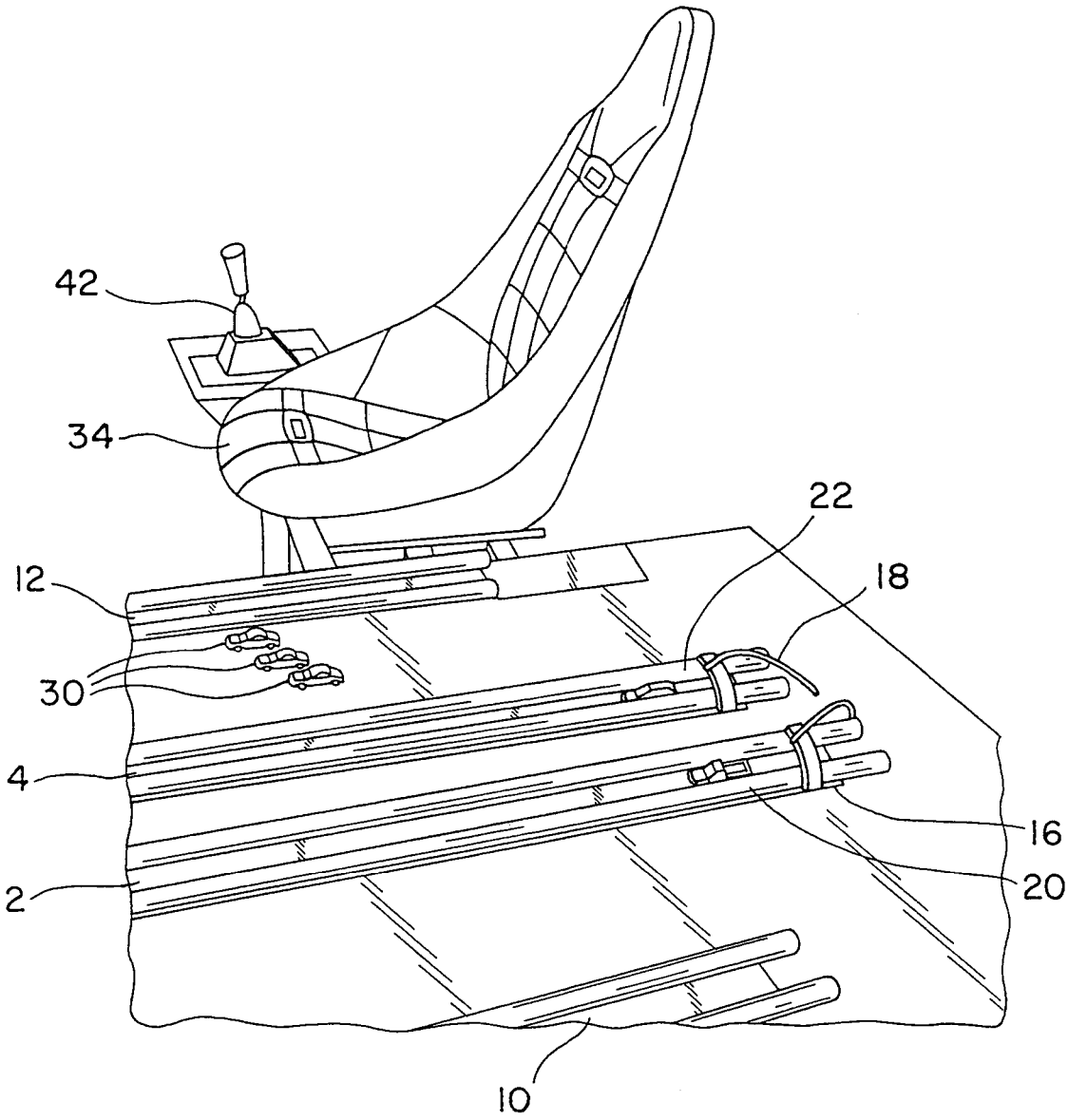
FIG. 2 shows a side view of the start of the track and one driver's seat and gearshift joystick.

FIG. 2 shows a side view of the start line of the track and the right driver's seat 34 and gearshift joystick 42. In one embodiment, the driver's seat is modeled after the bucket seat found in a real race car. Two cars 30 are positioned at the start 20, 22 of the inner sections 2, 4 of the track, and several more cars 30 are shown sitting beside the inner section 4 of the track. The two initial air jets 16, 18 are shown fixed to the track. Also visible from this angle are the outer sections, 10, 12 of the track.

Figure 3:
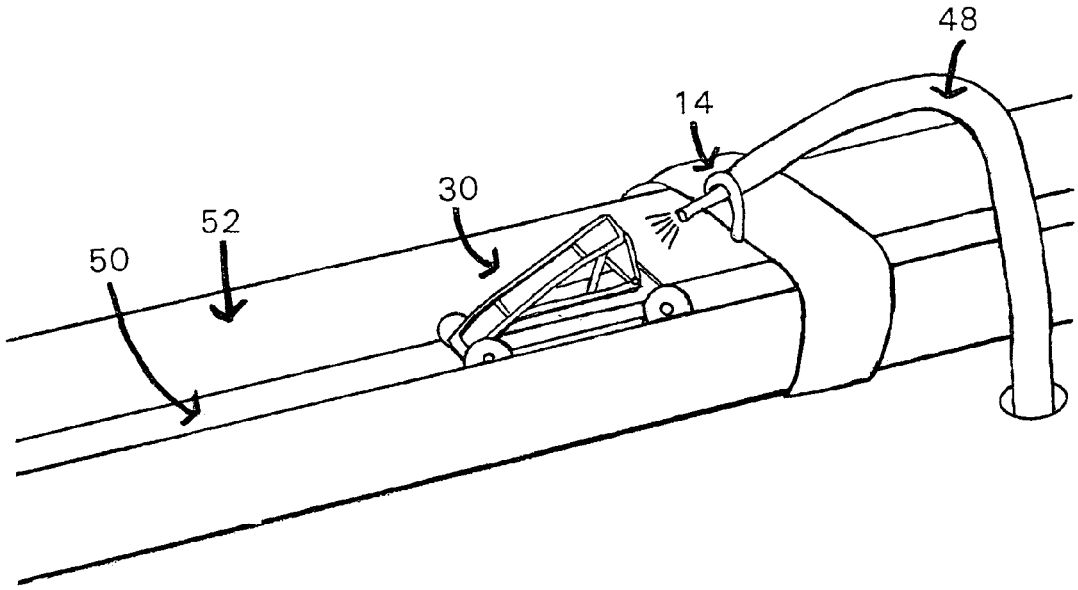
FIG. 3 illustrates a burst of air from an air jet propelling a car as it moves along the track.

FIG. 3 illustrates a burst of air from an air jet 14 propelling a car 30 as it moves along the track 50, 52. The bursts of air are controlled by the operator using the clutch 62 and the gearshift joystick 42. The pressurized air travels to the air jets 14 through air conduits 48. The car 30 is guided on the smooth plastic 50 of the track by the plastic pipes 52.

Figure 4:
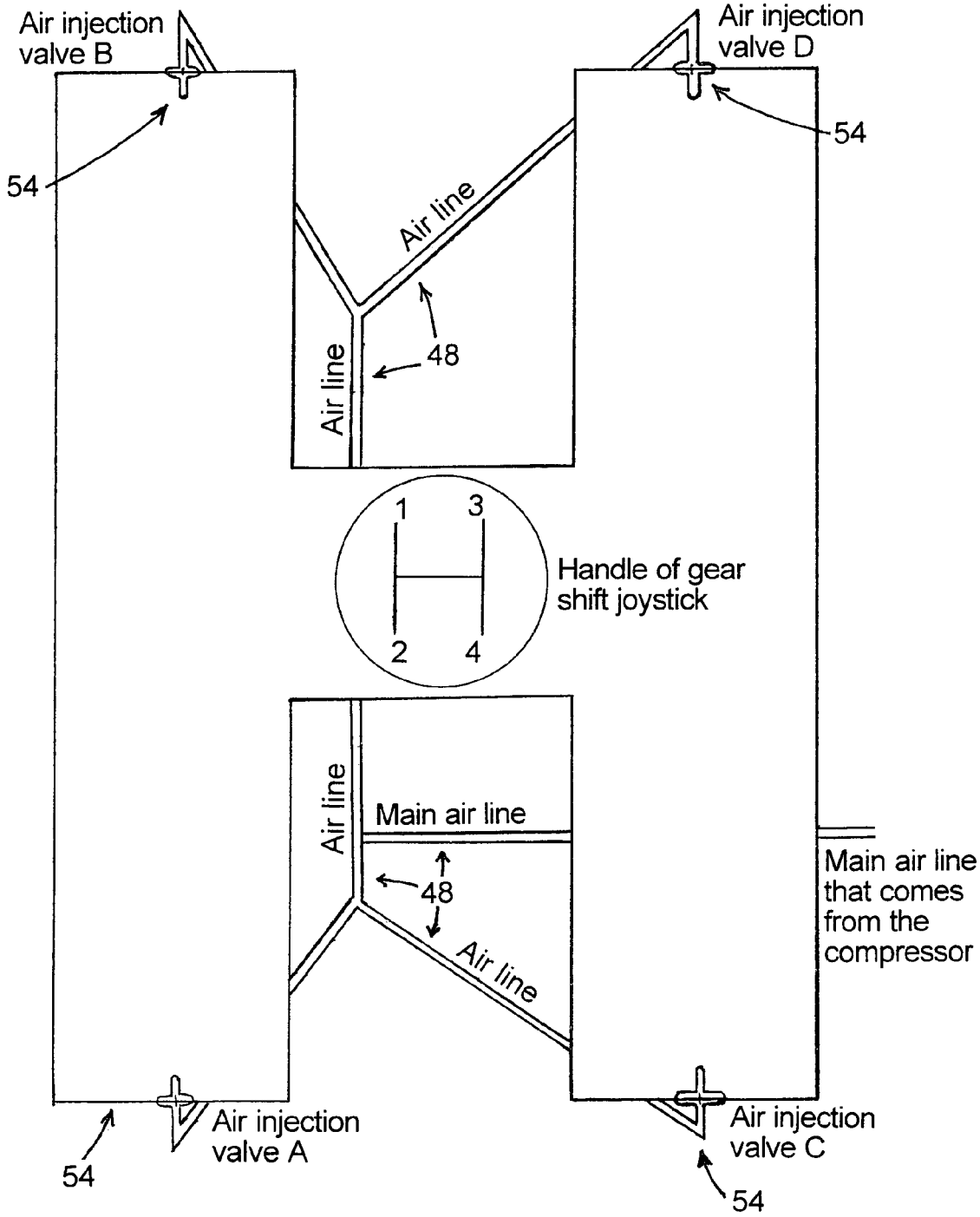
FIG. 4 is a diagram of the gearshift joystick.

FIG. 4 is a diagram of the gearshift joystick 42. The gears are arranged in the shape of an "H." Shifting to each gear activates an air valve 54, releasing a burst of pressurized air into the air conduits 48 and out of the corresponding air jet.

Figure 5:
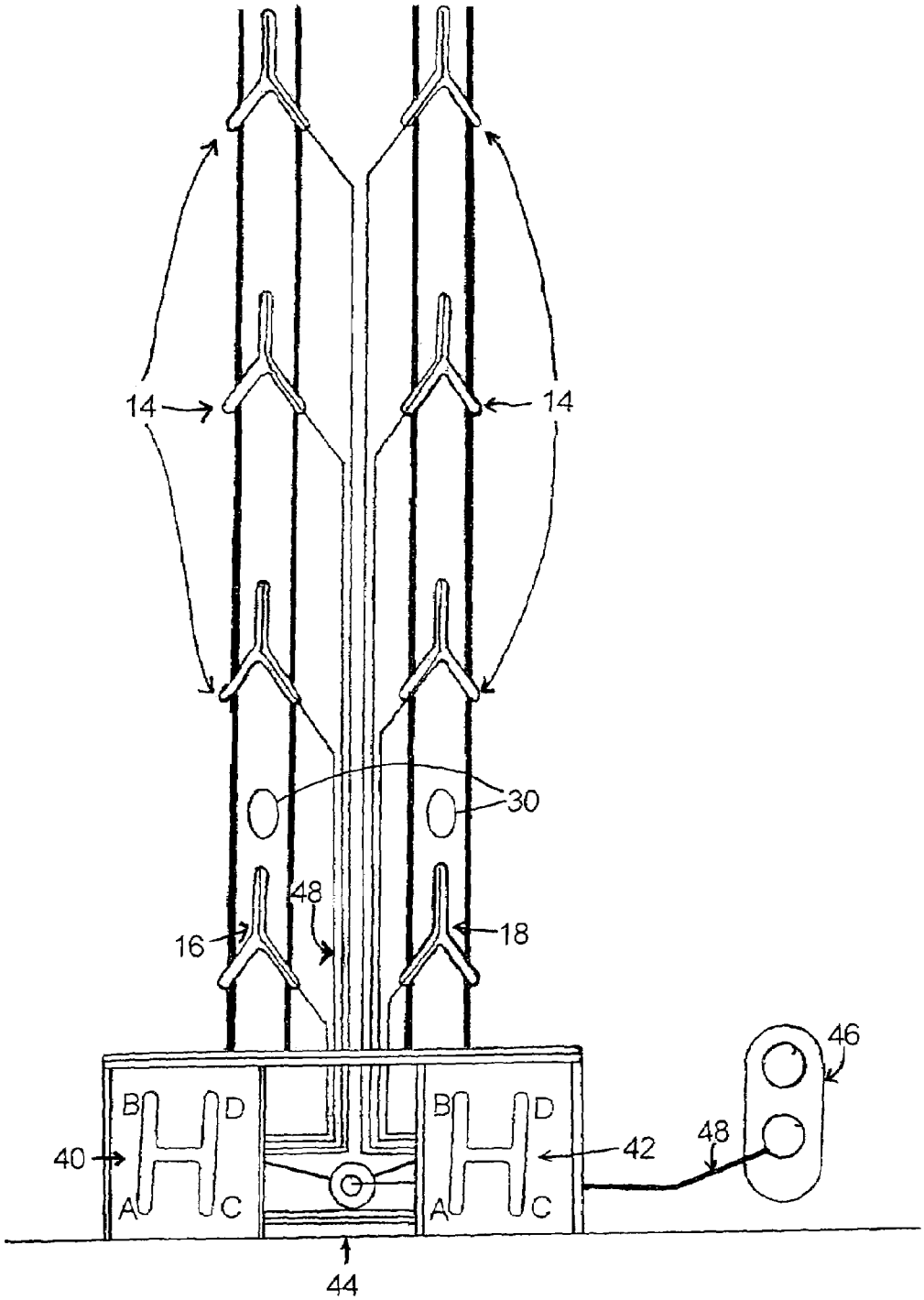
FIG. 5 is a diagram of the network of compressed air conduits.

FIG. 5 is a diagram of the network of compressed air conduits 48. The principal air conduit delivers air from the air compressor 46 to the system. The air regulator 44 controls the flow of air. The air is released by the gear shifts 40, 42 and travels along air conduits 48 until it is emitted in a burst from an air jet 14, 16, 18.

Figure 6A:
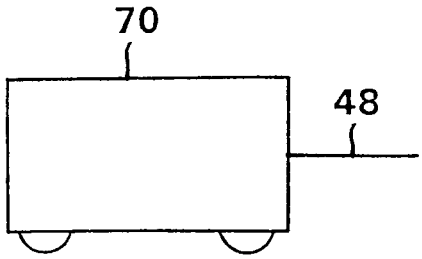
FIGS. 6A–6G illustrate the materials used to build the embodiment shown in FIGS. 1–5.

FIG. 6A illustrates the some of the materials used to build the embodiment shown in FIGS. 1–23. Air conduits 48 are shown connected to the air compressor 70. Air flows from the air compressor 70, through the air conduits 48.

Figure 6B:
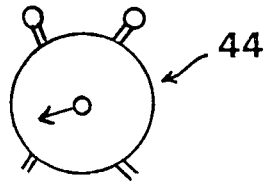

FIG. 6B illustrates the some of the materials used to build the embodiment shown in FIGS. 1–23. The air regulator 44 is shown. Air flows from the air compressor 70, through the air conduits 48, and through the air regulator 44.

Figure 6C:
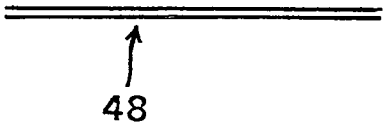

FIG. 6C illustrates the some of the materials used to build the embodiment shown in FIGS. 1–23. Specifically, the air conduits 48, which are made of copper, are shown. Air flows from the air compressor 70, through the copper air conduits 48 toward the air regulator 44 and the air jets 14, 16, 18.

Figure 6D:
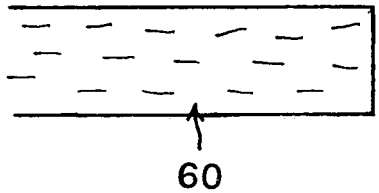

FIG. 6D illustrates the some of the materials used to build the embodiment shown in FIGS. 1–23. Specifically, the wooden platform 60 is shown. Any number of measurements are possible for the wooden platform 60. The dimensions of the wooden platform 60 are therefore not limited to the measurements shown in FIG. 24D, 1'×12'×10'.

Figure 6E:
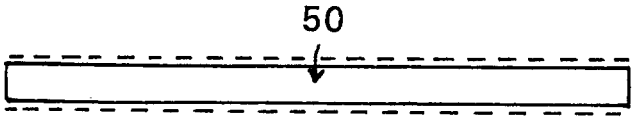

FIG. 6E illustrates the some of the materials used to build the embodiment shown in FIGS. 1–23. Specifically, the smooth plastic strips 50 of the track are shown. Any number of measurements are possible for the smooth plastic strips 50 of the track. The dimensions of the smooth plastic strips 50 are therefore not limited to the measurements shown in FIG. 24E, 2"×10'.

Figure 6F:
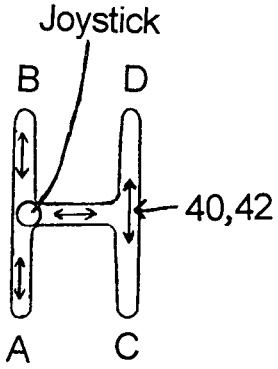

FIG. 6F illustrates the some of the materials used to build the embodiment shown in FIGS. 1–23. Specifically, the gear shifts 40, 42 are shown. The gears are arranged in the shape of an "H." Shifting to each gear activates an air valve 54, releasing a burst of pressurized air into the air conduits 48 and out of the corresponding air jet 14, 16, 18.

Figure 6G:
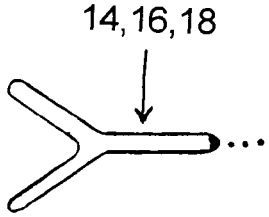

FIG. 6G illustrates the some of the materials used to build the embodiment shown in FIGS. 1–23. Specifically, the connecting base of the exit for the compressed air is shown. These are Y-shaped supports for the air jets 14, 16, 18 which are mounted to the track.

Figure 7:
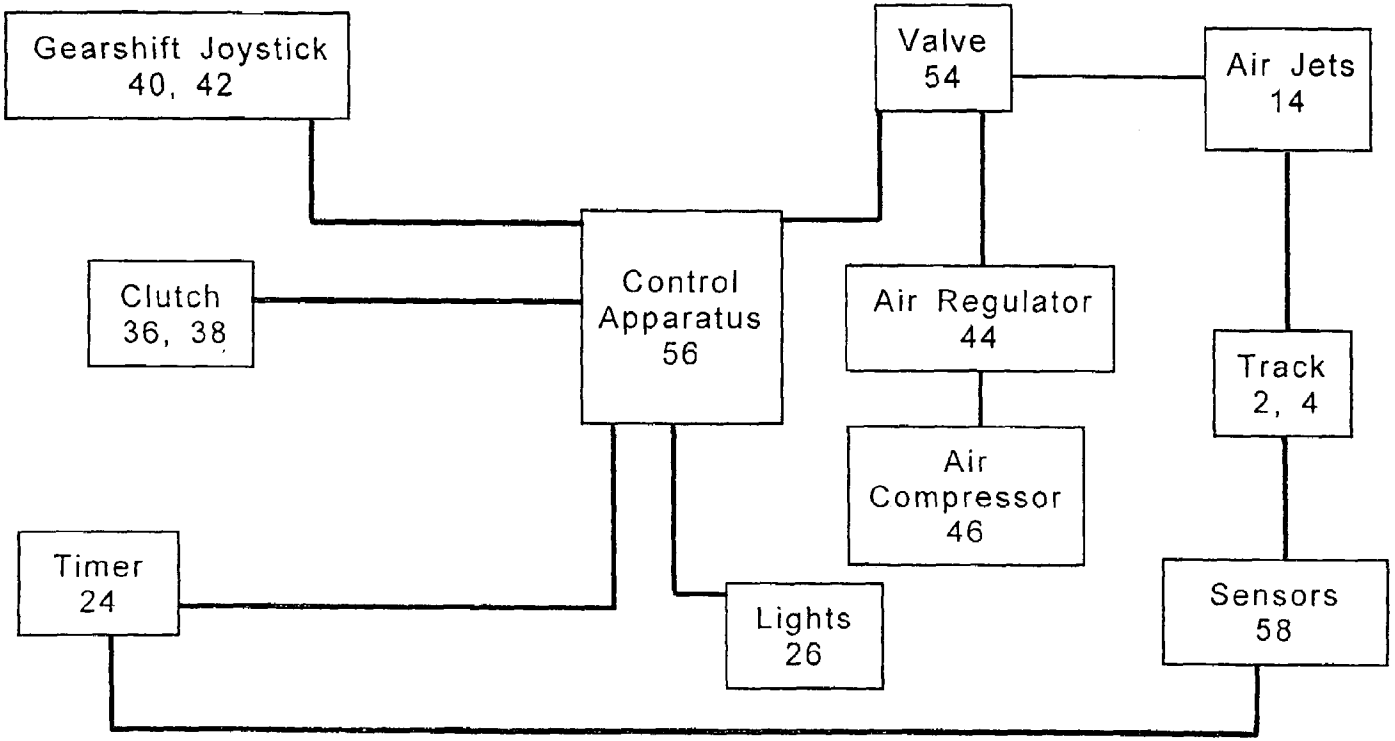
FIG. 7 is a diagram of the operation of the embodiment.

FIG. 7 is a diagram of the operation of one embodiment. At the start of the game, the signal lights 26 and timer 24 are activated by the control apparatus 56. When the clutch 36, 38 is depressed and the gear shift 40, 42 utilized, a valve 54 is opened, releasing air from the air compressor 46 via the air regulator 44, through the air conduits 48, and out of an air jet 14 on the track. When the cars have passed through the length of the racing portion of the track 2, 4, a sensor 58 is triggered to inform the timer 24 that the race is finished.

Examples of automotive clutch pedals which may be utilized in accordance with one or more embodiments of the present invention may be found in the following U.S. Pat. No. 4,301,908 entitled "Antivibration Device for a Clutch Pedal" issued on Nov. 24, 1981 to Fukuda et al.; U.S. No. D437,271S entitled "Mustang Car Brake And/Or Clutch Pedal" issed on Feb. 6, 2001 to Saleen; U.S. Pat. No. 5,901,614 entitled "Adjustable Clutch Pedal System" issued on May 11, 1999 to Ewing; U.S. Pat. No. 4,497,217 entitled "Clutch Pedal Operation Through a Fore and Aft Shaft in a Fire Wall of a Vehicle" issued on Feb. 5, 1985 to Hansen.

Examples of automotive gearshifts which may be utilized in accordance with one or more embodiments of the present invention may be found in the following U.S. Pat. No. 6,122,983 entitled "Shift Device for a Manual Transmission" issued on Sep. 26, 2000 to Hoffman; U.S. Pat. No. 4,633,728 entitled "Gear Selector Control for Manual Transmission" issued on Jan. 6, 1987 to May; U.S. Pat. No. 4,807,489 entitled "Gear Shift Device" issued on Feb. 28, 1989 to Schreiner et al.; U.S. Pat. No. 5,067,362 entitled "Control Device" issued on Nov. 26, 1991 to Holdenried; U.S. Pat. No. 5,979,262 entitled "Gearshift Device for a Motor Vehicle Manual Transmission" issued on Nov. 9, 1999 to Doelling et al.; U.S. Pat. No. 5,950,493 entitled "Gear Shift Tower Assembly" issued on Sep. 14, 1999 to Pritchard.

An examples of a motor race signaling system which may be utilized in accordance with one or more embodiments of the present invention may be found in the following U.S. patent: U.S. Pat. No. 6,380,863 B1 entitled "Signal Flag and Signaling System for Motor Racing" issued on Apr. 30, 2002 to Swoboda et al.

Examples of toy car tracks which may be utilized in accordance with one or more embodiments of the present invention may be found in the following U.S. patents: U.S. Pat. No. 5,038,685 entitled "Track Apparatus for a Toy Racing Car" issued on Aug. 13, 1991 to Yoneda et al.; U.S. Pat. No. 5,899,789 entitled "Toy Car Track Assembly With Propelling Mechanism and Collision Course" issued on May 4, 1999 to Rehkemper et al.; U.S. Pat. No. 5,924,927 entitled "Racing Game Apparatus" issued on Jul. 20, 1999 to Matsuura et al.; U.S. Pat. No. 5,501,455 entitled "Racing Game Machine with Varying Track Levels" issued on Mar. 26, 1996 to Hirata et al.; U.S. Pat. No. 6,227,932 B1 entitled "Toy Racing Car Track System" issued on May 8, 2001 to Ngai.

Examples of toy cars which may be utilized in accordance with one or more embodiments of the present invention may be found in the following U.S. Pat. No. Des. 320,821 entitled "Toy Racing Car" issued on Oct. 15, 1991 to Mochizuki; No. Des. 359,082 entitled "Toy Race Car" issued on Jun. 6, 1995 to Aker et al.; U.S. Pat. No. Des. 379,385 entitled "Toy Car" issued on May 20, 1997 to Yeh; No. Des. 383,808 entitled "Toy Race Car" issued on Sep. 16, 1997 to Choi; No. Des. 428,076 entitled "Toy Car" issued on Jul. 11, 2000 to Wise et al.

Examples of air jets which may be utilized in accordance with one or more embodiments of the present invention may be found in the following U.S. patents: U.S. Pat. No. 5,634,636 entitled "Flexible Object Handling System Using Feedback Controlled Air Jets," issued on Jun. 3, 1997 to Jackson et al.; U.S. Pat. No. 6,000,328 entitled "Gloss Control System Using Air Jets" issued on Dec. 14, 1999 to Mareiniss; U.S. Pat. No. 6,402,436 B1 entitled "Method and Device for Conveying Planar Ribbon of Crimped Fiber Using Air Jets" issued on Jun. 11, 2002 to Murphy; U.S. Pat. No. 5,180,119 entitled "Vertical Lift System Through Tangential Blowing of Air Jets Channelled Over the Top of Rotating Cylinders" issued on Jan. 19, 1993 to Picard; U.S. Pat. No. 4,305,536 entitled "Air Guides for Tape Transports Having Air Jets at Tangent Points" issued on Dec. 15, 1981 to Burdorf et al.

Examples of game control apparatuses which may be utilized in accordance with one or more embodiments of the present invention may be found in the following U.S. patents: U.S. Pat. No. 4,072,310 entitled "Control Apparatus for a Card Game Simulator" issued on Feb. 7, 1978 to Beam; U.S. Pat. No. 4,964,638 entitled "Control Apparatus for Game Machines" issued on Oct. 23, 1990 to ishida; U.S. Pat. No. 5,238,250 entitled "Computer Game Control Apparatus" issued on Aug. 24, 1993 to Leung et al.

Examples of timer displays which may be utilized in accordance with one or more embodiments of the present invention may be found in the following U.S. patents: No. Des. 390,799 entitled "Timer Display" issued on Feb. 17, 1998 to Uptegraph; No. Des. 304,960 entitled "Display Board with Timer" issued on Dec. 5, 1989 to Denton; U.S. Pat. No. 4,318,181 entitled "Timer Display Apparatus" issued on Mar. 2, 1982 to Kawakami et al.

Examples of automobile bucket seats which may be utilized in accordance with one or more embodiments of the present invention may be found in the following U.S. patents: No. Des. 422,154 entitled "Bucket Seat" issued on Apr. 4, 2000 to Lieberman et al.; No. Des. 279,437 entitled "Bucket Seat" issued on Jul. 2, 1985 to Downey, Jr.; U.S. Pat. No. 6,053,575 entitled "Motor Vehicle Seat with a Back Rest and a Bucket Seat" issued on Apr. 25, 2000 to Bauer et al.

What is claimed is:

1. A model car racing track, comprising:
a track;
said track having a left lane and a right lane;
said left and right lanes being U-shaped;
said track comprising:
smooth strips;
piping; and
a finish line;
a pressurized air network, comprising:
air conduits;
an air compressor;
an air regulator;
release valves; and
air jets;
at least one of said air jets being designated the initial air jet of each lane;
a control system, comprising:
clutches, being disposed to be operated by foot; and
gearshift joysticks;
a timer;
a sensor;
said sensor positioned at said finish line on each lane;
a light pole;
said light pole being fixed to stand vertically on the track;
at least two model cars;
said model cars being positioned on the plastic track;
said model cars being positioned under the initial air jets at the start of a game;
said light pole indicating the start of a race;
said clutches being depressed to enable use of said gearshift joysticks;
said gearshift joysticks releasing bursts of pressurized air from said air jets;
said pressurized air being transported by said air conduits;
said model cars moving along said plastic track;
said timer being configured to measure the time elapsed from the departure of said model cars from the start of said plastic track to the arrival of said model cars at said finish line; and
said timer being configured to display said elapsed time on a Light Emitting Diode display.

2. The model car racing track according to claim 1, comprising a race starting point disposed at an initial air jet, wherein:
said air jets are connected to said conduits and thus operatively connected to said release valves;
each of said air jets are configured and disposed to discharge bursts of pressurized air in each lane to propel model racing cars In each of said lanes upon actuation of a corresponding one of said release valves;
each of said clutches and its corresponding gearshift joystick are configured and disposed to control actuation of said release valves.

3. The model car racing track according to claim 2, wherein:
each of said clutches and its corresponding gearshift joystick are configured and disposed to simulate placement of a clutch and a gearshift in a full size car;
said sensor is positioned at said finish line on each lane and is configured to detect a car crossing said finish line;
said sensor is connected to said timer to stop said timer upon said sensor detecting a crossing said finish line;
said release valves are connected to said air conduits to control flow of pressurized air to said conduits; and
said clutch is disposed to be operated by foot.

4. A model car racing system, comprising:
a track;
at least two model cars configured to race on said track;
said track having a left lane and a right lane;
each of said lanes being U-shaped;
each of said lanes having a starting point and a finish line;
a timer configured to measure the time elapsed upon a model car traveling from said starting point to said finish line;
a sensor positioned at said finish line on each lane being configured to detect a car crossing said finish line;
said sensor being connected to said timer to stop said timer upon said sensor detecting a crossing said finish line;
a light pole;
said light pole being fixed to stand vertically;
a pressurized air network comprising:
air conduits configured to transport pressurized air;
release valves connected to said air conduits to control flow of pressurized air to said conduits;
air jets connected to said conduits and thus operatively connected to said release valves; and
each of said air jets being configured and disposed to discharge bursts of pressurized air in each lane to propel model racing cars in each of said lanes upon actuation of a corresponding one of said release valves; and a control system comprising:

clutches being disposed to be operated by foot;

gearshift joysticks;

each of said clutches and its corresponding gearshift joystick being configured and disposed to control actuation of said release valves; and each of said clutches and its corresponding gearshift joystick being configured and disposed to simulate size and placement of a clutch and a gearshift in a full size car.

5. The model car racing system according to claim 4, wherein:

said race starting point is disposed at an initial air jet; and said timer is configured to display said elapsed time.

6. A model car racing track, comprising:

a track;

said track having a left lane and a right lane;

a pressurized air network comprising:

air conduits configured to transport pressurized air;

release valves connected to said air conduits to control flow of pressurized air to said conduits;

air jets connected to said conduits and thus operatively connected to said release valves; and each of said air jets being configured and disposed to discharge bursts of pressurized air in each lane to propel model racing cars in each of said lanes upon actuation of a corresponding one of said release valves; and a control system comprising:

clutches being disposed to be operated by foot;

gearshift joysticks;

each of said clutches and its corresponding gearshift joystick being configured and disposed to control actuation of said release valves; and each of said clutches and its corresponding gearshift joystick being configured and disposed to simulate placement of a clutch and a gearshift in a full size car.

7. The model car racing track according to claim 6, comprising a race starting point disposed at an initial air jet.

8. The model car racing track according to claim 7, comprising a sensor.

9. The model car racing track according to claim 8, comprising a timer.

10. The model car racing track according to claim 9, wherein said track comprises a finish line.

11. The model car racing track according to claim 10, wherein said sensor is positioned at said finish line on each lane and is configured to detect a car crossing said finish line.

12. The model car racing track according to claim 11, wherein said sensor is connected to said timer to stop said timer upon said sensor detecting a crossing said finish line.

13. The model car racing track according to claim 12, wherein said left lane and said right lane are U-shaped.

14. The model car racing track according to claim 13, wherein said pressurized air network comprises an air compressor.

15. The model car racing track according to claim 14, wherein said pressurized air network comprises an air regulator.

16. The model car racing track according to claim 15, comprising a light pole.

17. The model car racing track according to claim 16, wherein said light pole is fixed to stand vertically on said track.

18. The model car racing track according to claim 17, wherein said light pole indicates the start of the race.

19. The model car racing track according to claim 18, wherein said track comprises:

smooth strips; and piping.

20. The model car racing track according to claim 19, wherein said timer is configured to display elapsed time on a Light Emitting Diode display.

* * * * *